United States Patent [19]

Katz

[11] Patent Number: 4,768,812

[45] Date of Patent: Sep. 6, 1988

[54] FLASHING FOR ROOF VENT PIPES

[75] Inventor: Bruce Katz, West Bloomfield, Mich.

[73] Assignee: Multi-Flashings, Inc., Madison Heights, Mich.

[21] Appl. No.: 115,854

[22] Filed: Nov. 2, 1987

[51] Int. Cl.[4] ..... E04B 5/48

[52] U.S. Cl. ..... 285/43; 285/177; 52/219

[58] Field of Search ..... 285/42, 43, 44, 177; 52/58, 199, 219

[56] References Cited

U.S. PATENT DOCUMENTS

| | | | |
|---|---|---|---|
| Re. 26,026 | 5/1966 | Dibley . | |
| 558,025 | 4/1896 | Barry . | |
| 580,515 | 4/1897 | Weeden . | |
| 1,000,506 | 8/1911 | Galbraith . | |
| 1,258,884 | 3/1918 | Fife . | |
| 1,317,446 | 9/1919 | Hollaender . | |
| 1,349,894 | 8/1920 | Lord | 285/43 |
| 1,558,503 | 10/1925 | Pressler . | |
| 2,244,280 | 6/1941 | Aghnides . | |
| 2,985,465 | 5/1961 | Church . | |
| 3,098,663 | 7/1963 | Dibley . | |
| 3,151,894 | 10/1964 | Wilson et al. . | |
| 3,163,101 | 12/1964 | Caparrelli . | |
| 3,461,625 | 8/1969 | Sandow | 52/58 |
| 3,602,530 | 8/1971 | Elwort . | |
| 3,731,952 | 5/1973 | Elwart | 285/44 X |

FOREIGN PATENT DOCUMENTS

| | | | |
|---|---|---|---|
| 1509132 | 2/1969 | Fed. Rep. of Germany | 52/219 |
| 511895 | 6/1952 | France . | |
| 1287555 | 2/1962 | France | 52/58 |
| 1080837 | 8/1967 | United Kingdom | 52/219 |

*Primary Examiner*—Dave W. Arola

*Attorney, Agent, or Firm*—Cullen, Sloman, Cantor, Grauer, Scott & Rutherford

[57] ABSTRACT

A flashing for a roof top vent pipe includes a frustoconical shield member to enclose a portion of the vent pipe and a support base with a central longitudinal axis extending lateral longitudinaly thereof for mounting and securing upon the roof top. An annular upper portion of the shield member sealingly engages around the vent pipe. A pair of laterally spaced elongated stiffener beads extend along the under side of the base upon opposite sides of the longitudinal axis in engagement with the rooftop for stiffening and reinforcing the base at its exposed forward edge against upward bending and flexing under wind pressure to exclude water and debris.

5 Claims, 1 Drawing Sheet

FLASHING FOR ROOF VENT PIPES

RELATED PATENTS

The present application discloses an improvement over U.S. Pat. No. 3,602,530 dated Aug. 31, 1971, and U.S. Pat. No. 3,731,952 dated May 8, 1973, both owned by Applicant's assignee.

BACKGROUND OF THE INVENTION

Previously in the use of flashing for roof pipes of the type disclosed in the foregoing patents there was the problem of exposed end portions of the flashing support base bending or flexing upwardly under wind pressure permitting entry of debris and water thereunder with subsequent access to the interior of the building construction.

DESCRIPTION OF THE PRIOR ART

Flashings or similar structures for sealing roof vent pipes and the like are disclosed in one or more of the following patents:

U.S. Reg No. 26,026, and U.S. Pat. Nos. 558,025, 580,515, 1,000,506, 1,258,884, 1,317,446, 1,558,503, 2,244,280, 2,985,465, 3,098,663, 3,151,894, 3,163,101 and Belgium Pat. No. 511,895 of June 1952, as well as the above-related patents believed the most pertinent to this disclosure.

The flashings shown in the related patents above are preferably constructed of a plastic or like material such as polyethylene so as to yieldably and sealingly engage around the vent pipe, so as to withstand weather and to conform to expansion and contractions of the vent pipe or other roof structures over protracted periods. Flashings disclosed in the above related patents are adapted to fit various size vent pipes over which they are sealed by the use of O-rings such as disclosed in U.S. Pat. No. 3,731,952.

SUMMARY OF THE INVENTION

An important feature of the present invention is to provide an improved flashing for roof pipes wherein the base portion of the flashing is to a limited extent flexible and which is adapted to overlie the rooftop surface, being inclined downwardly and wherein a means is provided in the construction of the flashing base in the form of a pair of laterally spaced stiffener beads which extend along the undersurface thereof engageable with the rooftop for stiffening and reinforcing the base at its exposed outer edge against upward bending and flexing under wind pressure to exclude water and debris.

As another feature the present flashing includes a frusto-conical shield member to enclose a portion of the vent pipe and a support base extending laterally and longitudinally of the shield member for mounting and securing upon the rooftop. An annular upper portion of the shield member sealingly engages around the roof vent pipe, and a pair of laterally spaced elongated stiffener beads are molded into and extend along the undersurface of the base upon opposite sides of its longitudinal axis. Said beads are in engagement with the rooftop for stiffening and reinforcing the base at its exposed forward edge against upward bending and flexing under wind pressure to exclude moisture and debris.

As still another feature, the laterally spaced parallel reinforcement beads upon the undersurface of the support base are spaced rearwardly of the leading edge of the support base to provide a better contact of the base with the rooftop surface.

These and other features and objects will be seen from the following specification and claims in conjunction with the appended drawings.

THE DRAWINGS

It will be understood that the above drawing illustrates a preferred embodiment of the invention, and that other embodiments are contemplated within the scope of the claims hereinafter set forth.

DETAILED DESCRIPTION

Figure 1:
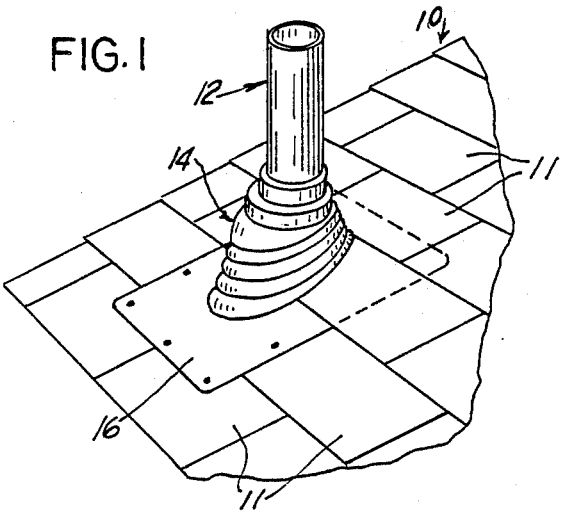
FIG. 1 is a fragmentary perspective view of a rooftop and a flashing of the present invention installed around a vent pipe.
Figure 5:
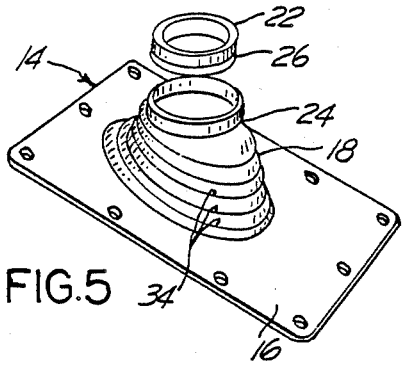
FIG. 5 is a perspective view of the flashing illustrating the top portion of the flashing as removed to accommodate a vent pipe of larger diameter.

Rooftop 10 is fragmentarily shown in FIG. 1, having a conventional vent pipe 12 extending vertically therethrough. The present flashing 14 peripherally engages vent pipe 12 and has a flat base 16 with a series of peripheral apertures therethrough adapted for securing to rooftop 10. Any means of securing may be employed such as nails or tacks.

Flashing 14 includes a substantially frusto-conically shaped body or shield member 18 having a top and bottom for enclosing a portion of vent pipe 12. Shield member 18 extends from the substantially flat base 16 at an obtuse angle relative to the plane of said base and relative to its central longitudinal axis 20, FIG. 2.

Figure 4:
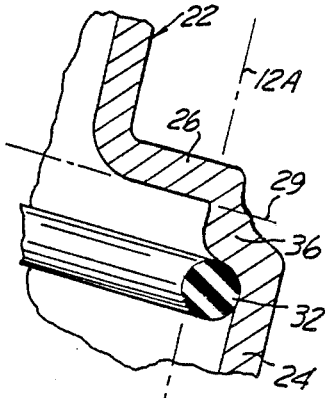
FIG. 4 is an enlarged fragmentary cross-sectional view of a portion of the flashing illustrating the location of the cutting line to remove the top portion of the flashing for enlargement of the diameter of the vent pipe opening.
Figure 3:
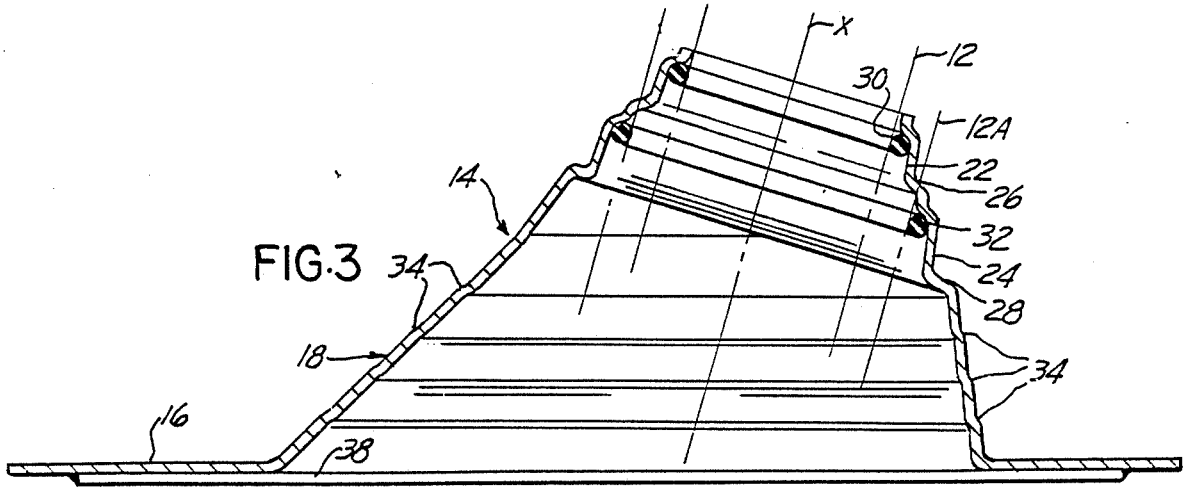
FIG. 3 is a vertical section taken in the direction of arrows 3—3 of FIG. 2 on an increased scale and indicating in phantom lines vent pipes of different diameters extending through the flashing.

At the top of the shield member 14 there is an upper rim or top portion formed into a pair of concentric cylindrical stepped portions 22 and 24, FIGS. 3 and 4 connected to each other and to the body of the flashing by connecting ridge portions 26 and 28 respectively.

The uppermost portion 22 is dimensioned so that its inner surface will conform substantially with the outer diameter surface of vent pipe 12. In this case it is a conventional three-inch pipe shown in phantom lines, FIG. 3. In the event the flashing 14 is to be used with a larger pipe, as for example a conventional four-inch pipe indicated by the phantom lines 12A, the uppermost portion 22 is removed by cutting, severing the top 26 of the flashing at the junction formed by the ridge 26 with the inner cylindrical portion 24 along cutting line 29, FIG. 4.

Each of the portion 22, 24 is concentric with each other around center line X of the flashing, FIG. 3, and is provided with an O-ring sealing means 30 and 32 respectively which are of slightly smaller inner diameter than the respective vent pipes 12 and 12A. Said rings are stretchable such that they will each conform readily to the shape of the respective vent pipe including any minor imperfections and irregularities. This maintains an efficient water seal between the vent pipe and the flashing inner surface. A plurality of circular corrugations 34 extend around the annular portion of shield member 18 of the flashing adjacent the roof surface so that it will flex within limits to conform base 16 to rooftops 10 of varying pitches, and also to adapt to contractions and expansions of the roof structure. This is disclosed in U.S. Pat. No. 3,731,952.

If it is desired to use vent pipe 12A of larger diameter, the top portion 26 of body 18 or shield member of the flashing is cut off along line 29, FIG. 4, below top 22. Cutting line 29 is in a plane normal to central axis X, FIG. 3. This assures concentric installation of the larger vent pipe 12A in the flashing around the central axis. After the top portion 26 has been cut off along line 29, an axially cylindrical ridge portion 36 remains as a continuation of inner portion 24 forming a retaining means for O-ring 32 holding the O-ring in place as it is compressed when the flashing is installed downwardly over said vent pipe.

As shown in FIG. 1, the flashing 14 is installed on rooftop 10 in such fashion that an upper portion of the flat base 16 is extended underneath shingles 11 and the remaining lower portion lies on top of the shingles, as is a standard application in the roofing industry. The present flashing 14 is preferably molded of a suitable plastic material such as a low density polyethylene which has the properties required to conform sufficiently to imperfections in the vent pipe and retain the shape of the pipe imperfections and irregularities at all times thereafter while yet being weather resistant, tough and durable and slightly flexible.

In order to overcome the problems in the prior art of upward flexing and bending of the lowermost inclined portion of the support base 16 under wind pressure, the present invention includes a means for stiffening and reinforcing the support base. Such means includes a pair of laterally spaced stiffening beads 38, FIGS. 2, 3 and 6. These extend along the underside of support base 16 upon opposite sides of the central longitudinal axis 20 and are parallel.

The corresponding beads 38 in the illustrative embodiment are generally convex in shape or semicircular in cross-section and function to materially stiffen the support base 16 reinforcing its forward surfaces against upward bending and flexing under wind pressure for excluding water and debris.

In the illustrative embodiment the respective stiffener beads are molded as an integral part of support base 16 depending therefrom a distance approximating the thickness of support base 16. Such sufficient additional stiffening of the support base prevents upward flexing of forward portions thereof under wind pressure.

Figure 2:
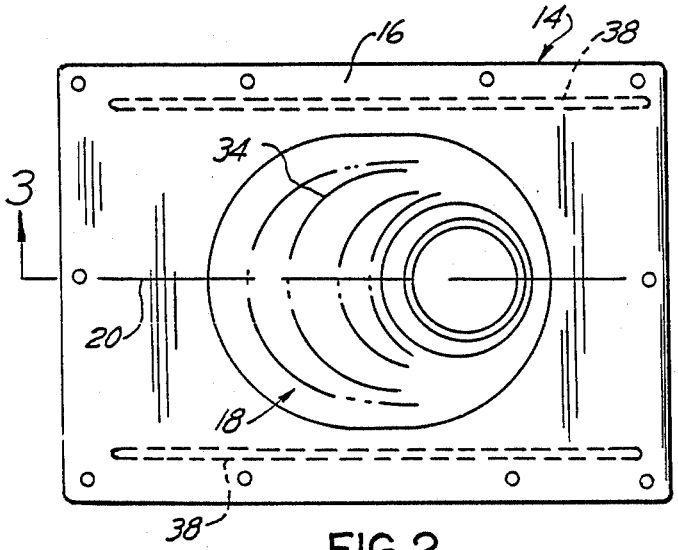
FIG. 2 is a top plan view of the vent pipe and flashing of FIG. 1, on an increased scale.
Figure 6:
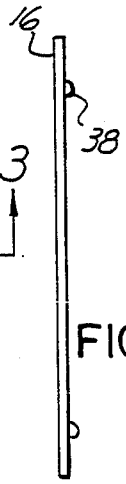
FIG. 6 is an end view of the flashing base in FIG. 2 showing the base support reinforcing and stiffening beads.

The respective beads 38 are transversely convex, FIG. 6, and the leading ends thereof towards the left of FIG. 2 are spaced rearwardly of the forward edge of support base 16. This is to permit the forward end portion of the support base to come into engagement with roof surface 11 for a better seal.

Formation of the respective beads 38 upon and depending from the under surface of support base 16 renders the support base slightly longitudinally concave tending to bias forward end portions of the base downwardly against the rooftop surface for improved sealing.

The present invention contemplates that the reinforcement beads may be applied to the support base of a flashing for a single roof top vent pipe or for a flashing which is adapted to selectively match vent pipes of different diameters.

Having described my invention, reference should now be had to the following claims.

I claim:

1. A flashing for a rooftop vent pipe comprising a substantially frusto-conical shield member having a top and bottom for enclosing a portion of a vent pipe upstanding from said rooftop;

an apertured support base having a central longitudinal axis at the bottom of said shield member as a part thereof and extending laterally and longitudinally thereof adapted to engage the rooftop surface;

an annular upper portion adjacent the top of said shield member dimensioned to sealingly engage around said vent pipe, said upper portion being of a plastic material having the property of deforming to conform to the surface of said vent pipe; and a pair of laterally spaced elongated stiffener beads upon and depending from said base as a part thereof upon opposite sides of and spaced from said axis, engagable with said rooftop surface, said beads stiffening and reinforcing said base at its exposed forward edge against upward bending and flexing under wind pressure to prevent entry of water and debris under said support base, and said beads terminating short of said exposed forward edge.

2. A flashing for a rooftop vent pipe comprising a substantially frusto-conical shield member having a top and bottom for enclosing a portion of a vent pipe upstanding from said rooftop;

an apertured support base having a central longitudinal axis at the bottom of said shield member as a part thereof and extending laterally and longitudinally thereof adapted to engage the rooftop surface;

an annular upper portion adjacent the top of said shield member dimensioned to sealingly engage around said vent pipe, said upper portion being of a plastic material having the property of deforming to conform to the surface of said vent pipe; and a pair of laterally spaced elongated stiffener beads upon and depending from said base as a part thereof upon opposite sides of and spaced from said axis, engagable with said rooftop surface; said beads stiffening and reinforcing said base at its exposed forward edge against upward bending and flexing under wind pressure to prevent entry of water and debris under said support base;

said beads rendering said base longitudinally concave upon its under surface, biasing the forward portion of said support base downwardly against said rooftop surface.

3. In the flashing for a rooftop vent pipe of claim 2, said beads being transversely convex.

4. In the flashing for a rooftop vent pipe of claim 2, said beads at their forward ends being spaced rearwardly of the corresponding end of said support base to facilitate engagement of said forward end with the rooftop surface.

5. A flashing for rooftop vent pipes of different diameters comprising a substantially frusto-conical shield having a top and bottom for enclosing a portion of a vent pipe upstanding from said rooftop;

an apertured support base having a central longitudinal axis at the bottom of said shield member as a part thereof and extending laterally and longitudinally thereof adapted to engage the rooftop surface;

said shield member having a plurality of stepped upper portions of varying diameters dimensioned to engage the outer diameter of differently sized vent pipes;

the smaller of said portions being severable for adapting said shield to selected vent pipes of different diameters; and a pair of parallel laterally spaced elongated stiffener beads upon and depending from said support base as a part thereof upon opposite sides of and spaced from said axis, engagable with said rooftop surface;

said beads stiffening and reinforcing said support base at its exposed forward edge against upward bending and flexing under wind pressure to prevent entry of water and debris under said support base, and said beads terminating short of said exposed forward edge.

* * * * *